US010946646B2

(12) United States Patent
Oonuki et al.

(10) Patent No.: US 10,946,646 B2
(45) Date of Patent: Mar. 16, 2021

(54) RECORDING APPARATUS AND CONTROL METHOD THEREFOR

(71) Applicant: CANON KABUSHIKI KAISHA, Tokyo (JP)

(72) Inventors: Kenichi Oonuki, Nishitokyo (JP); Daisuke Kobayashi, Kawasaki (JP); Satoshi Seki, Kawasaki (JP); Tsukasa Doi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/514,383

(22) Filed: Jul. 17, 2019

(65) Prior Publication Data

US 2020/0031115 A1 Jan. 30, 2020

(30) Foreign Application Priority Data

Jul. 30, 2018 (JP) ..... JP2018-142385

(51) Int. Cl.
*B41J 29/38* (2006.01)
*B41J 2/045* (2006.01)

(52) U.S. Cl.
CPC ..... *B41J 2/0457* (2013.01); *B41J 2/0458* (2013.01); *B41J 2/04563* (2013.01)

(58) Field of Classification Search
CPC ..... B41J 2/0458; B41J 2/04541; B41J 2/0455
USPC ..... 347/10
See application file for complete search history.

(56) References Cited

U.S. PATENT DOCUMENTS 5,646,655 A * 7/1997 Iwasaki ..... B41J 2/04515 347/17
8,262,183 B2 * 9/2012 Oshima ..... B41J 2/04588 347/10
2002/0145639 A1 * 10/2002 Masuda ..... B41J 2/04541 347/14
2003/0043218 A1 * 3/2003 Murata ..... B41J 2/04596 347/14
2004/0033084 A1 * 2/2004 Akizuki ..... G03G 15/2046 399/69
2009/0244161 A1 10/2009 Yamamoto

FOREIGN PATENT DOCUMENTS

JP 2010-259279 A 11/2010

* cited by examiner

*Primary Examiner* — Lam S Nguyen
(74) *Attorney, Agent, or Firm* — Canon U.S.A., Inc. I.P. Division

(57) ABSTRACT

Heating is conducted sequentially by dividing a heating operation into first heating control and second heating control consuming higher electric power than that in the first heating control.

19 Claims, 11 Drawing Sheets

RECORDING APPARATUS AND CONTROL METHOD THEREFOR

BACKGROUND

Field

The present disclosure relates to a recording apparatus including an electric accumulation unit and a control method for the recording apparatus.

Description of the Related Art

In an apparatus frequently switching between drive and stop of a motor such as a recording apparatus, consumption current significantly fluctuates, and an ampacity value of a power supply unit configured to drive the motor is determined in consideration of a maximum current value for the fluctuating consumption current. Since the recording apparatus has a higher maximum current value than an electronic apparatus consuming equivalent electric power, it is not easy to reduce the power supply unit in size, which causes an issue in downsizing the entire apparatus.

As an inkjet-type recording apparatus, one in which a recording head ejecting ink includes a heating element is known. This heating element is used to maintain and control ink ejection performance. US2009/0244161 describes that ink in a recording head is heated to cause bubbles adhering to a common liquid chamber communicating to an ink flow path to expand and to cause the bubbles to be discharged from the common liquid chamber out into an ink supply chamber.

On the other hand, Japanese Patent Laid-Open No. 2010-259279 discloses a method for using an electric accumulation element so that an apparatus may be operated even in a case in which supply power of a power supply unit is low. By charging power in the electric accumulation element when current consumption by a motor or the like is low and discharging and using electric charge accumulated in the electric accumulation element when the current consumption is high, the motor or the like can be operated even in a case in which supply power of the power supply unit is low. Japanese Patent Laid-Open No. 2010-259279 also describes that, in a case in which voltage of the electric accumulation element is a threshold value or less, the motor or the like stops driving and stands by until the electric accumulation element is charged. Accordingly, time to increase voltage of the electric accumulation element during the stand-by state can be secured, and a shortage of supply power from the external power supply can be supplemented in subsequent operation.

However, heating with use of the heating element requires high power consumption, and in a case of using the method in Japanese Patent Laid-Open No. 2010-259279, stand-by time is required to supplement electric charge. However, in a case in which the motor or the like stands by while heating is conducted to reach a target temperature, the temperature of the recording head and the ink in the recording head will decrease during the stand-by time. The temperature reached by heating the heating element with use of electric charge supplemented during the stand-by time is lower than the decreased temperature reached while the electric charge is supplemented. Even in a case in which the temperature is higher than the decreased temperature, the temperature is not much higher than the temperature before the stand-by time. For this reason, it is difficult to heat the recording head to reach a high temperature, and in the method in Japanese Patent Laid-Open No. 2010-259279, the target temperature is restricted.

SUMMARY

The present disclosure allows a recording head to be heated to a higher temperature in heating control of the recording head. Heating may be conducted sequentially by dividing a heating operation into first heating control and second heating control consuming higher electric power than that in the first heating control.

According to an aspect of the present disclosure, a recording apparatus includes a recording head including an ejection port for ejecting ink and a heating element for heating the recording head to heat ink in the recording head, a detection unit configured to detect a temperature of the recording head, an electric accumulation unit configured to accumulate electric power supplied from an external power supply, an acquisition unit configured to acquire information about an accumulated electricity amount accumulated in the electric accumulation unit, and a heating control unit configured to drive the heating element to heat the recording head such that the temperature of the recording head reaches a reached target temperature with use of the electric power accumulated in the electric accumulation unit based on a detection result of the temperature of the recording head by the detection unit and the information acquired by the acquisition unit, wherein, in a state in which the electric power is being supplied from the external power supply to the electric accumulation unit, the heating control unit conducts first heating control of heating the recording head to a middle target temperature and then heats the recording head in second heating control of consuming higher electric power than that in the first heating control to increase the temperature of the recording head to a reached target temperature, which is higher than the middle target temperature, and the heating control unit conducts the first heating control such that the accumulated electricity amount of the electric accumulation unit does not fall below an accumulated electricity amount required for the second heating control at a stage of moving from the first heating control to the second heating control.

Further features of the present disclosure will become apparent from the following description of exemplary embodiments (with reference to the attached drawings).

Figure 2A:
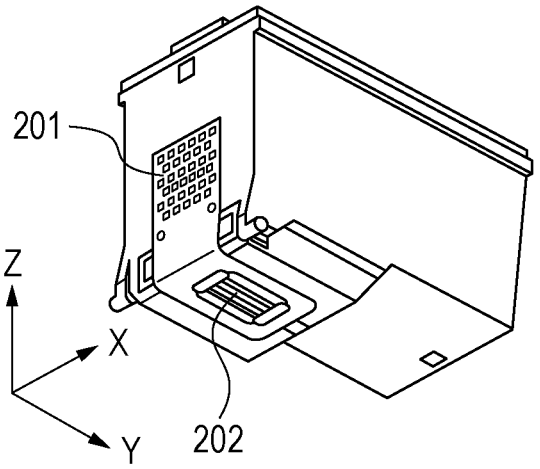
Figure 2B:
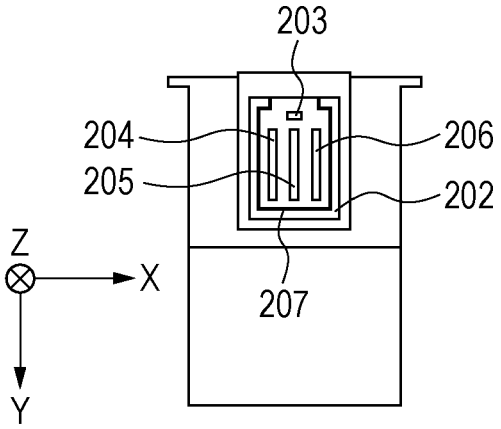
Figure 2C:
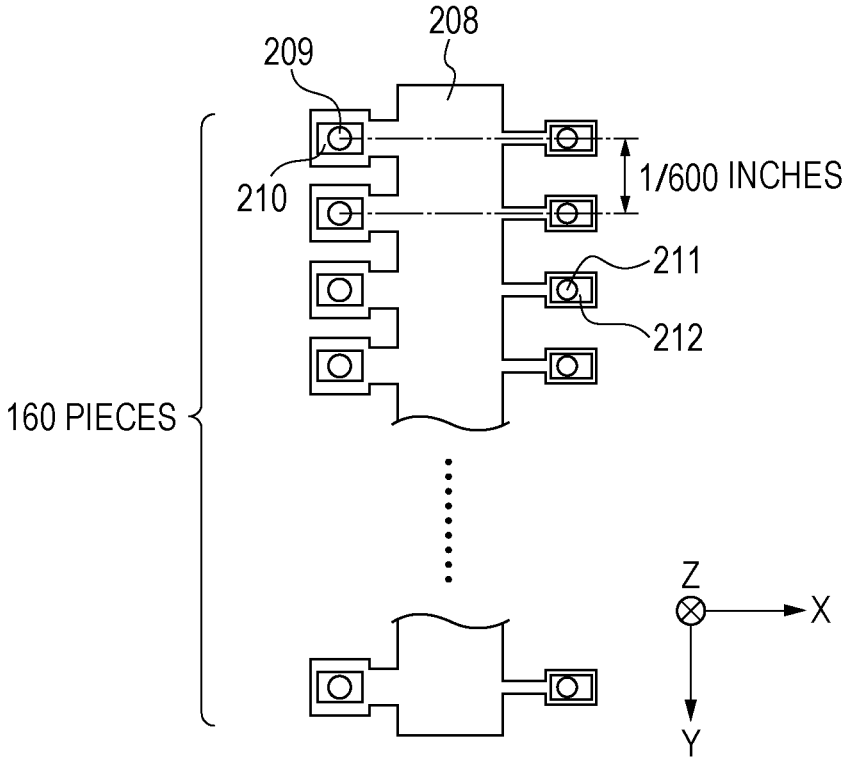

Each of FIGS. 2A to 2C is a schematic configuration diagram illustrating a configuration of a recording head of the recording apparatus according to the embodiment.

Figure 3:
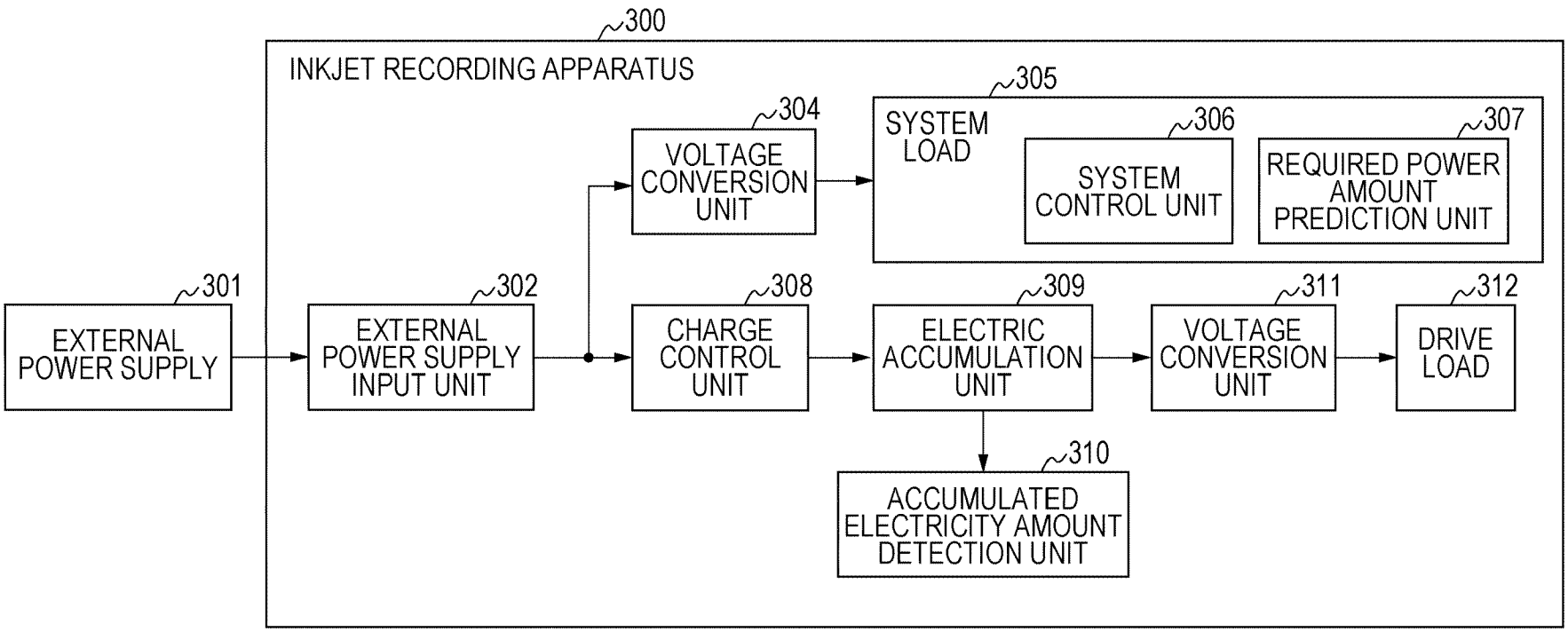

FIG. 3 is a block diagram illustrating a power supply control configuration of the recording apparatus according to the first embodiment.

Figure 4:
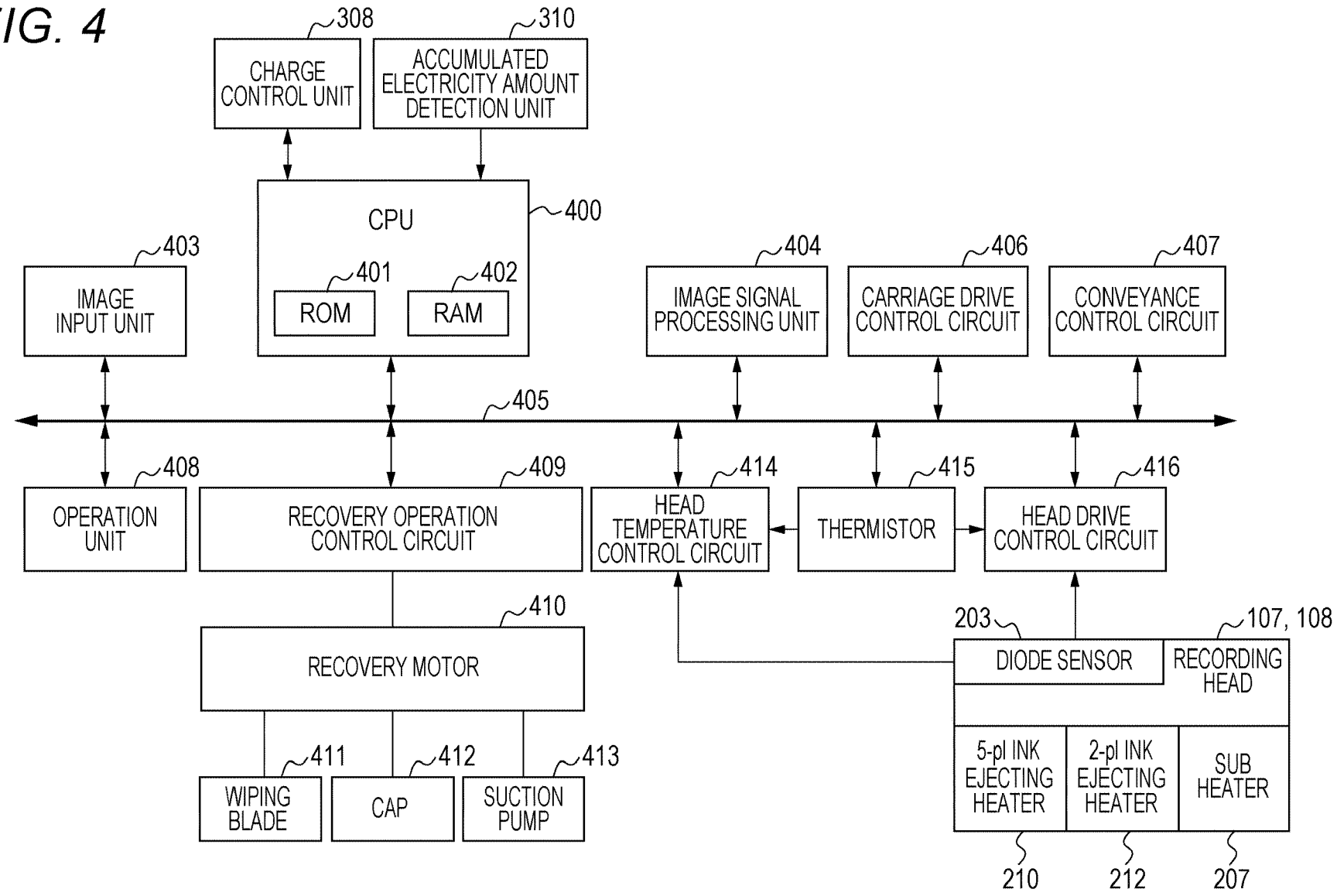

FIG. 4 is a block diagram illustrating an entire control configuration according to the embodiment.

Figure 5:
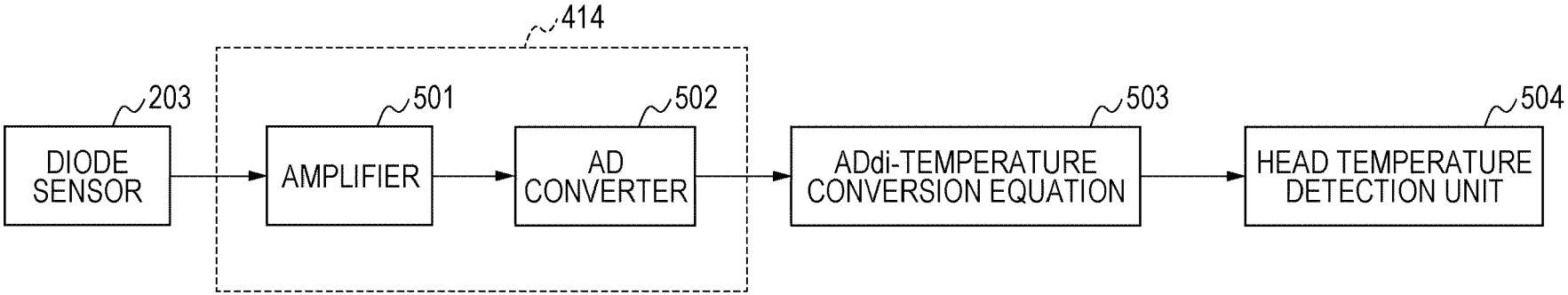

FIG. 5 is a block diagram illustrating a flow of processing in a head temperature control circuit according to the embodiment.

Figure 6:
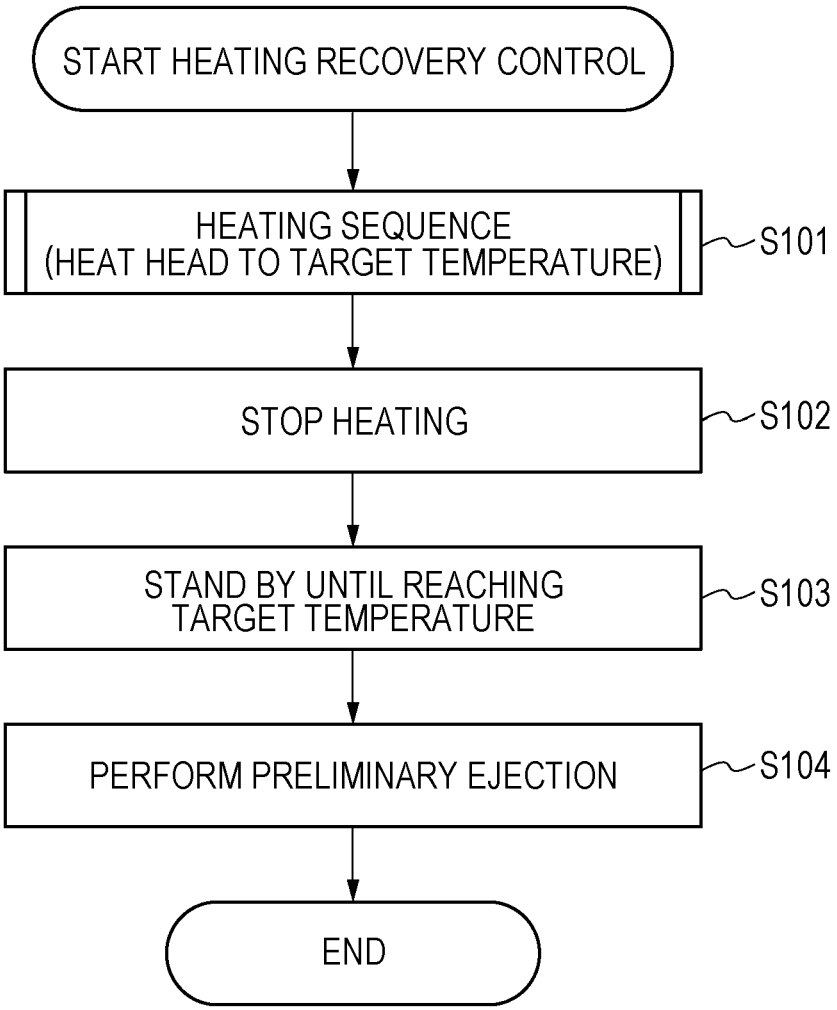

FIG. 6 is a flowchart of entire heating recovery control according to the embodiment.

Figure 7:
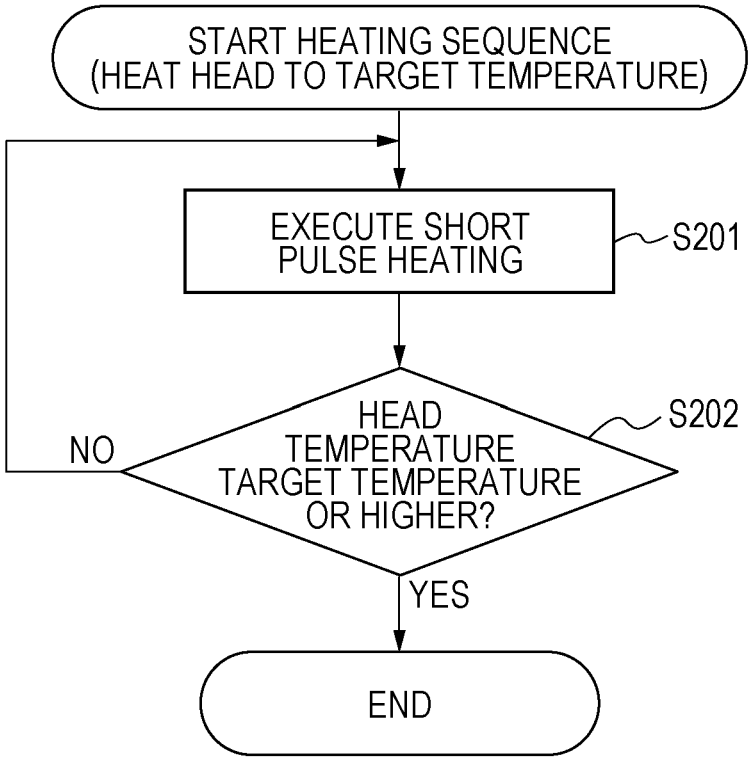

FIG. 7 is a control flowchart of a heating sequence according to a comparative mode.

Figure 8:
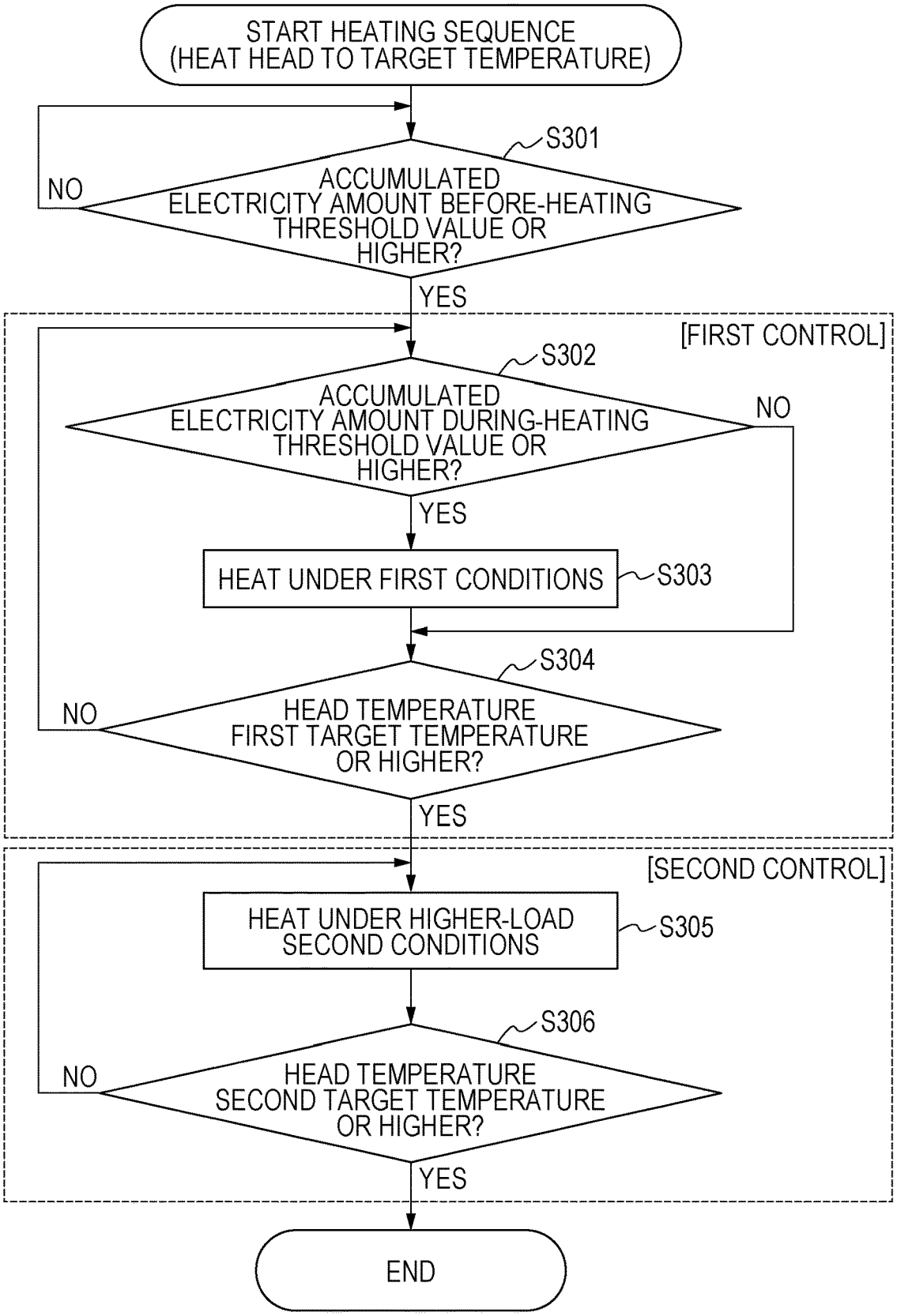

FIG. 8 is a control flowchart of a heating sequence according to the first embodiment.

Figure 9:
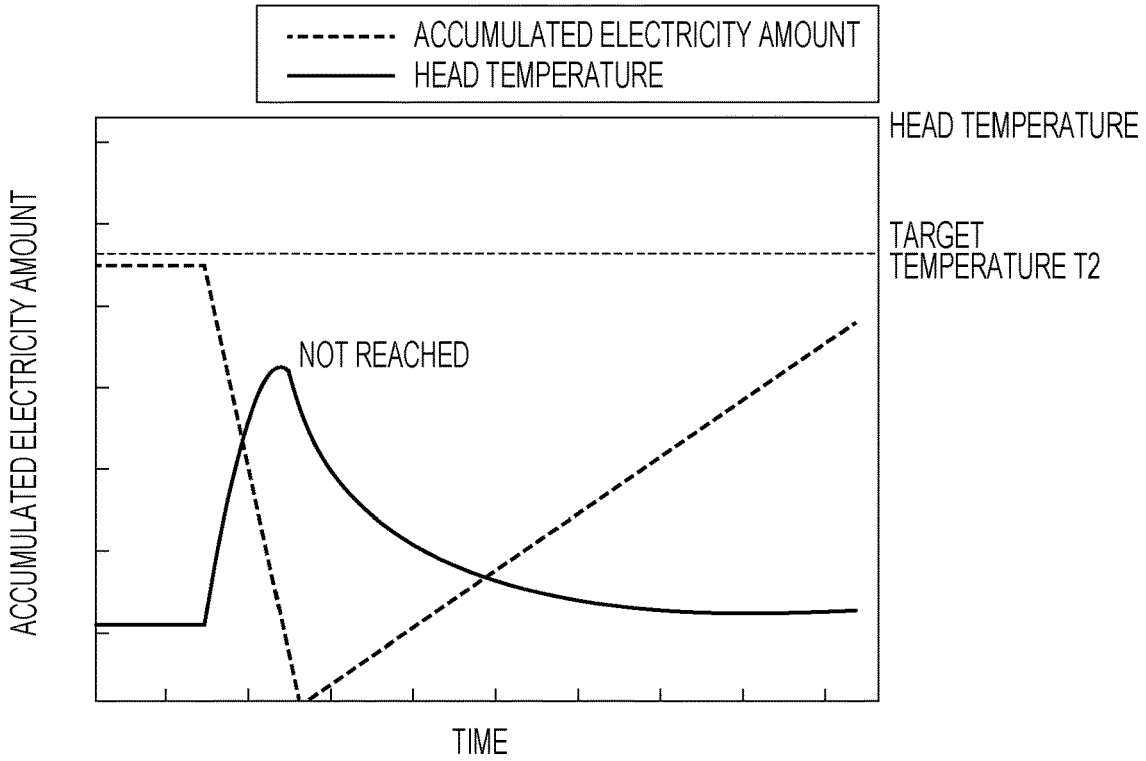

FIG. 9 is a graph illustrating the relationship between a head temperature and the accumulated electricity amount according to the comparative mode.

Figure 10:
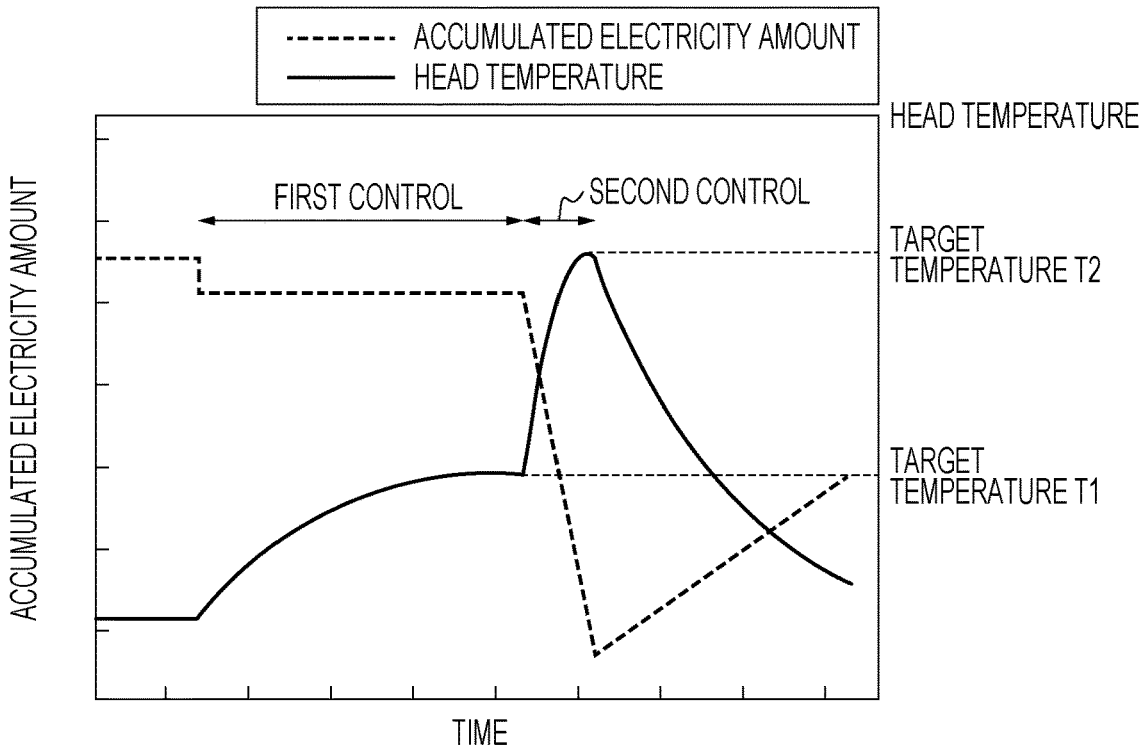

FIG. 10 is a graph illustrating the relationship between a head temperature and the accumulated electricity amount according to the embodiment.

Figure 11:
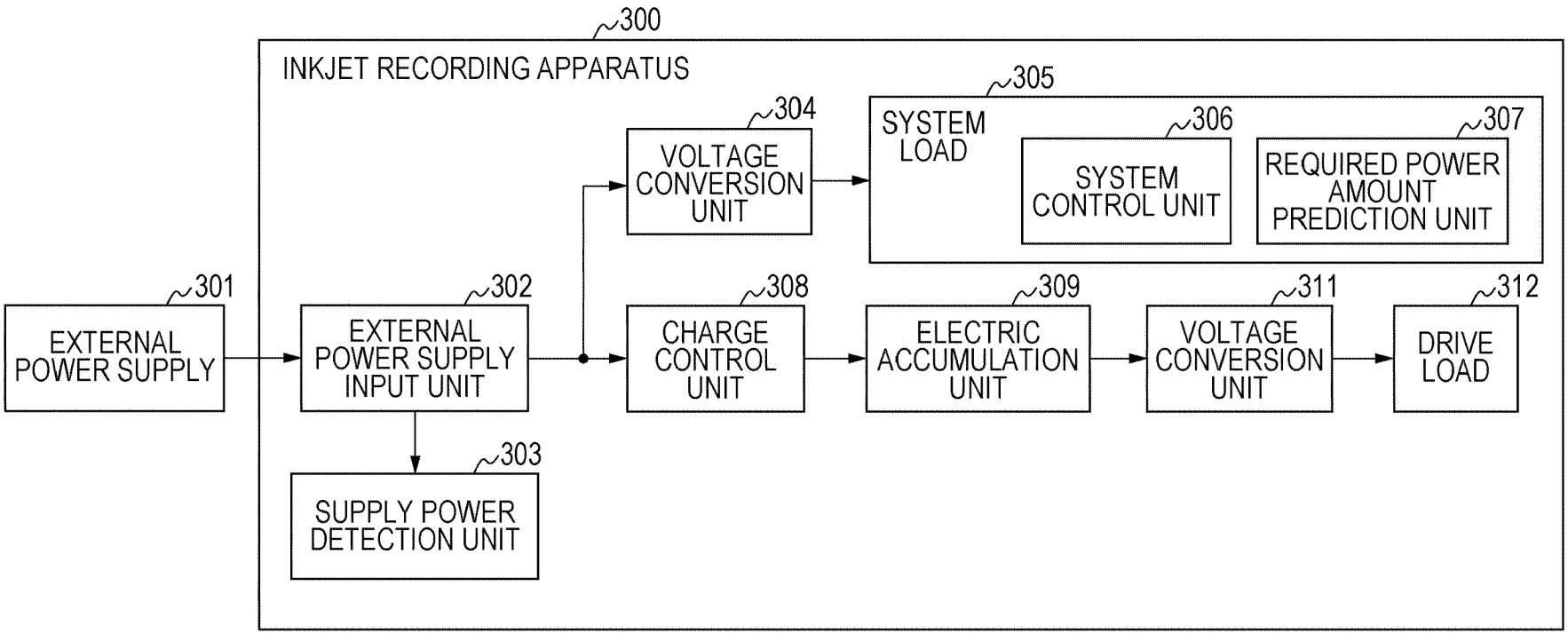

FIG. 11 is a block diagram illustrating a power supply control configuration of a recording apparatus according to a second embodiment.

Figure 12:
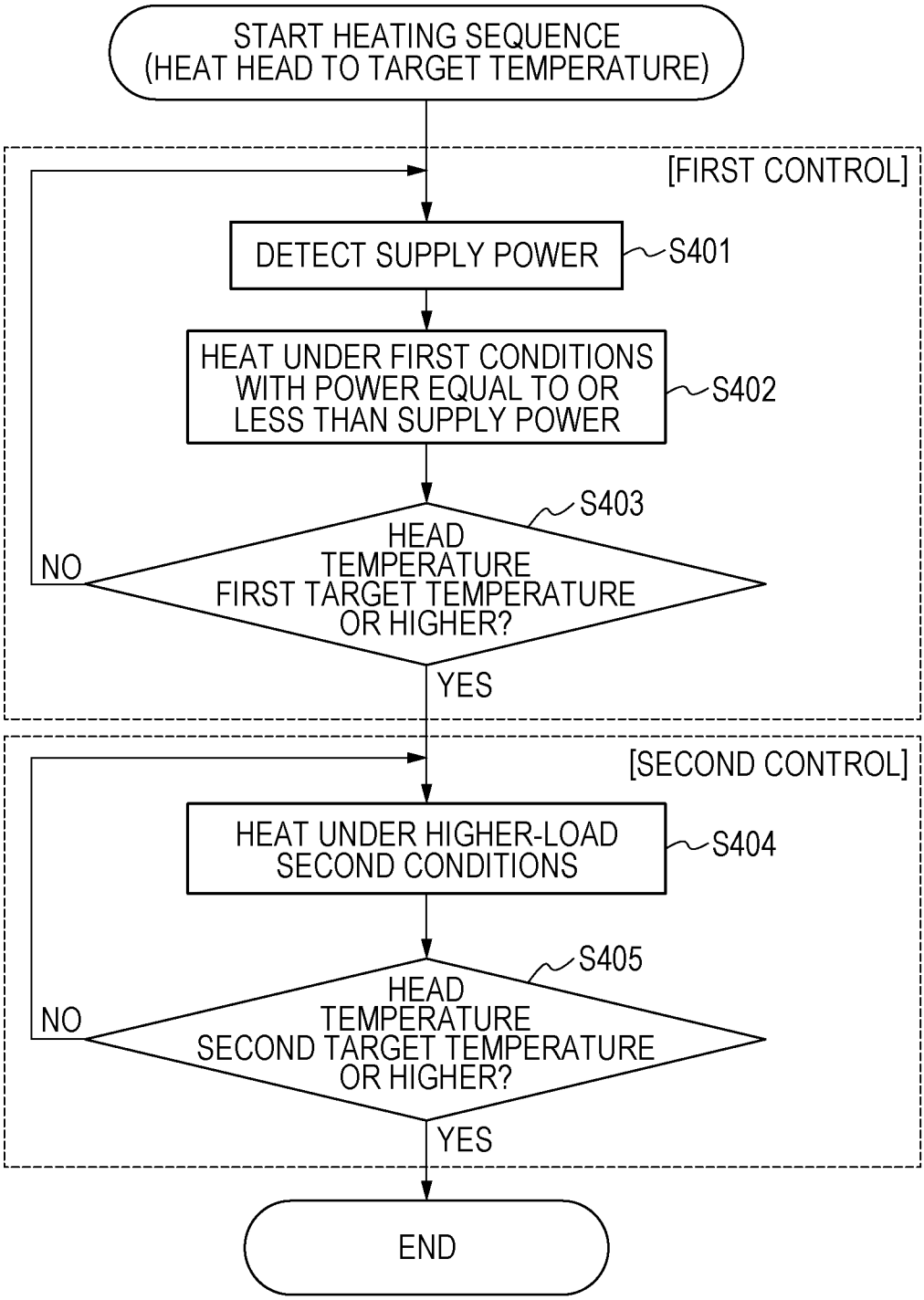

FIG. 12 is a control flowchart of a heating sequence according to the second embodiment.

DESCRIPTION OF THE EMBODIMENTS

Hereinbelow, embodiments of the present disclosure will be described in detail with reference to the drawings.

First Embodiment

<Entire Configuration>

Figure 1:
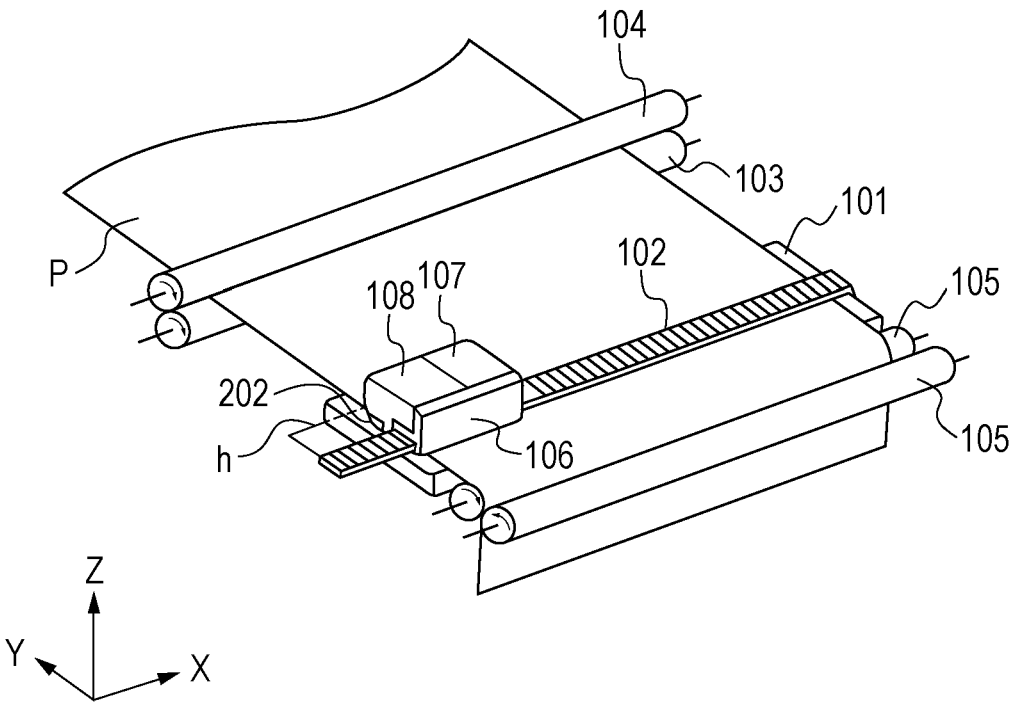
FIG. 1 is a perspective view of a recording apparatus according to an embodiment.

FIG. 1 is a schematic perspective view of an inkjet recording apparatus 300 (hereinbelow, a recording apparatus 300) according to an embodiment. In this figure, in each of inkjet recording heads 107 and 108, a recording head and an ink tank are integrated. Although the tank-integrated-type recording head is used in the present embodiment, an inkjet recording head may have a configuration in which the ink tank is detachable from the recording head. Ink colors in the ink tank of the first recording head 107 are cyan, magenta, and yellow while an ink color in the ink tank of the second recording head 108 is black. Each of the recording heads 107 and 108 includes a recording chip 202 including arrayed ink ejection ports and ejects ink from the respective ejection ports for recording. A feed roller 105 functions to be rotated, feed a recording medium P, and hold the recording medium P. A conveyance roller 103 as well as an auxiliary roller 104 is rotated while holding the recording medium P and intermittently conveys the recording medium P in a +Y direction.

A platen 101 supports a rear surface of the recording medium P at a recording position. A carriage 106 supports the recording head 107 and the recording head 108 and moves in an X direction. The carriage 106 reciprocates in the X direction in a recording area at the time of recording on the recording medium via a carriage belt 102 driven by a not-illustrated carriage motor. The position and the speed of the carriage 106 are detected by a not-illustrated encoder sensor mounted on the carriage 106 and an encoder scale lying across the recording apparatus, and movement of the carriage 106 is controlled by the position and the speed. Ink is ejected from the recording heads 107 and 108 while the carriage 106 is moving to cause recording to be conducted on the recording medium.

When no recording is conducted, or recovery operation of the recording heads is conducted, the carriage 106 stands by at a home position h as illustrated by the dashed line in the figure. A not-illustrated recovery unit is provided at the home position h. The recovery unit includes a wiping mechanism wiping off ink droplets adhering to the surfaces of the ejection ports (ejection port surfaces) of the recording heads 107 and 108 to recover the ejection port surfaces into a normal state. The recovery unit further includes a capping mechanism adapted to cover the ejection ports and a suction mechanism adapted to suck ink from the ejection ports by the capping mechanism.

<Recording Head Configuration>

Each of FIGS. 2A to 2C is a schematic configuration diagram illustrating a configuration of the recording head 107 according to the present embodiment. FIG. 2A is a perspective view illustrating the recording head 107. FIG. 2B is a partially transparent schematic view illustrating a state of the recording head 107 as seen in a Z direction. The recording head 107 receives a recording signal via a contact pad 201 from a recording apparatus main body so that electric power required for driving of the recording head may be supplied. A recording chip 202 includes a substrate provided with an ejecting heater serving as an energy generating element generating energy for ejecting ink. This substrate is made of silicon, for example. The recording chip 202 is also provided with a diode sensor 203 detecting a temperature of the substrate and an ejection port forming member for forming an ejection port array 204 ejecting cyan ink, an ejection port array 205 ejecting magenta ink, and an ejection port array 206 ejecting yellow ink. The recording chip 202 is further provided with a sub-heater 207 for heating ink serving as a heating element arranged to largely surround the ejection port arrays 204, 205, and 206. By applying voltage to this sub-heater 207, the substrate of the recording head is heated, and ink is heated by the heated substrate. The sub-heater 207 is made of aluminum or another metal itself or an alloy thereof, and a resistance value of the sub-heater 207 changes depending on the temperature. Also, the sub-heater 207 may include a single layer or a plurality of layers. Also, the sub-heater 207 may not surround the circumference of the ejection port arrays with a sequential member as long as the sub-heater 207 is formed to allow the entirety of the ejection port arrays to be heated somewhat uniformly.

FIG. 2C is an enlarged view of the ejection port array 204 for cyan ink of the recording head 107. On both sides of an ink chamber 208 in FIG. 2C, ejection ports 209 each ejecting 5-pl ink and ejection ports 211 each ejecting 2-pl ink are arranged. Directly under (in the +Z direction) the respective ejection ports, 5-pl ejecting heaters 210 and 2-pl ejecting heaters 212 are respectively arranged as heating elements. By applying voltage to the ejecting heaters 210 and 212, heat energy is generated, and ink is ejected from the ejection ports. The number of the ejection ports ejecting 5-pl ink and the number of the ejection ports ejecting 2-pl ink are 160 each. The distance between the ejection ports adjacent in the Y direction is 1/600 inches so that the recorded pixel density may be 600 dpi. By giving as short driving pulses as not to cause ink to eject to the ejecting heaters 210 and 212, ink can be heated. Such heating control will hereinbelow be referred to as short pulse heating control. Also, the sub-heater can be at ink by transferring heat to the ink via a member in the substrate close to the sub-heater.

In the recording apparatus according to the present embodiment, the temperature of the recording head substrate and the temperature of the ink (hereinbelow collectively referred to as a head temperature) are controlled by the short pulse heating control and the control of the sub-heater. In the present embodiment, heating is conducted to increase the temperature of ink around the ejection ports, and the below-mentioned diode sensor 203 measures the temperature of the substrate and cannot measure the temperature of the ink directly. Since the substrate is heated when the ink is heated, the temperature of the ink and the temperature of the substrate in the recording head are approximately equal. For this reason, the temperature of the substrate is regarded as the head temperature in the present description. In the short pulse heating control and the sub-heater heating control in the present embodiment, the amount of heat energy (heating capability) generated per unit of time is larger in the short pulse heating control. Thus, the short pulse heating control can increase the temperature of the recording heat in shorter time. On the other hand, while recording is being executed, the ejecting heaters 210 and 212 are not used for the short pulse heating control since the ejecting heaters 210 and 212 are being used for ejection of ink. In consideration of the above respects, in the present embodiment, the sub-heater heating control is executed in a case in which the ink is heated until the target temperature is reached during recording, and the short pulse heating control is executed in a case in which the ink is heated until the target temperature is reached during no recording.

As a result of feedback control by switching between heating and non-heating of the recording head substrate so that a temperature derived based on a detection value of the below-mentioned diode sensor 203 may be close to the target temperature, the head temperature is controlled by the sub-heater heating control and the short pulse heating control. The same is true of the not-illustrated second recording head 108.

<Configuration for Power Supply>

FIG. 3 is a block diagram illustrating a schematic functional configuration for power supply of the recording apparatus 300 according to the present embodiment. An external power supply 301 according to the present embodiment is a PC including a USB port, for example. Here, the external power supply 301 may be a PC complying with USB2.0 or USB3.0. Alternatively, the external power supply 301 may be a PC, a charger or the like complying with a USB charging standard such as Battery Charging Specification or a standard for high-power supply such as USB Power Delivery. Alternatively, the external power supply 301 may be an AC adapter including no USB interface.

An external power supply input unit 302 is a connector for connection to the external power supply 301. Electric power obtained from the external power supply input unit 302 is supplied to a voltage conversion unit 304 and a charge control unit 308. The electric power is converted into voltage for driving a system load 305 in the voltage conversion unit 304 and is then consumed in the system load 305. A below-mentioned heating sequence according to the present embodiment is conducted in a state in which the external power supply input unit 302 and the external power supply 301 are connected and in which electric power is supplied from the external power supply 301. The system load 305 includes a system control unit 306 including a CPU, a memory, and the like conducting system control of an image forming apparatus and a required power amount prediction unit 307. The required power amount prediction unit 307 is a unit predicting the amount of electric power required at the time of execution of each operation such as image recording. In the present embodiment, with use of a value for the amount of electric power predicted by the required power amount prediction unit 307, the system control unit 306 sets target voltage to be charged by an electric accumulation unit 309 and controls the electric accumulation unit 309.

The charge control unit 308 charges the electric accumulation unit 309 with use of electric power input from the external power supply input unit 302. Maximum charge current at this time is controlled so that the sum of current to be charged by the charge control unit 308 and current to be consumed in the voltage conversion unit 304 may not exceed assumed ampacity of the external power supply 301. For the electric accumulation unit 309, an electric double layer capacitor (hereinbelow referred to as an EDLC) is preferably used, for example, since the EDLC can perform quick charge and discharge and is less deteriorated by repetitive charge and discharge. Meanwhile, a charge current value of the charge control unit 308 is determined in consideration of a charge capability of the charge control unit 308 itself and the maximum charge current of the electric accumulation unit 309, as well as the aforementioned condition that the sum does not exceed the allowable supply current of the external power supply 301.

An accumulated electricity amount detection unit 310 detects the accumulated electricity amount of the electric accumulation unit 309. A detection method is to be selected appropriately based on the type of the electric accumulation unit 309. For example, terminal voltage of the electric accumulation unit 309 may be measured to estimate the electric charge amount that is accumulated, or input/output current of the electric accumulation unit 309 may be observed to cause the electric accumulation unit 309 to function as a Coulomb counter. As another method, the accumulated electricity amount may be calculated by clarifying supply power from the external power supply 301.

The accumulated electricity amount detection unit 310 is connected to the system control unit 306, and the accumulated electricity amount is used as information for control according to the present embodiment.

A voltage conversion unit 311 converts voltage of the electric accumulation unit 309 into voltage required for a drive load 312. In a case in which the EDLC is used as the electric accumulation unit 309, the electric charge amount that is accumulated and the terminal voltage are proportional to each other, and the terminal voltage is thus lowered significantly as a result of discharge. Preferably, the voltage conversion unit 311 can deal with a broad input voltage range so that the voltage conversion unit 311 can withstand voltage drop caused by the discharge of the electric accumulation unit 309. A drive load 312 indicates drives such as the feeding unit 101, the conveying unit 102, the recording mechanism unit 103, and the recovery mechanism unit 104 in FIG. 1 in the recording apparatus 300. Although the drive load 312 is provided with electric power of the external power supply 301 through the electric accumulation unit 309 in the present embodiment, the drive load 312 may be connected to both the electric accumulation unit 309 and the external power supply 301 and may be provided with electric power directly from the external power supply 301. In this case, the route of power supply is switched. In a case in which the external power supply 301 is one that supplies a small amount of supply power, the external power supply 301 first accumulates electricity in the electric accumulation unit 309 and then supplies the electric power to the drive load 312. In a case in which the external power supply 301 is one that supplies a large amount of supply power, the external power supply 301 supplies electric power to the drive load 312.

As for the drive load 312, in accordance with determination of the system control unit 306, application of current to the recording head and operation/stop of the respective motors are controlled.

Operation of the recording apparatus 300 configured as above will be described.

When the external power supply 301 is connected to the external power supply input unit 302, electric power obtained from the external power supply input unit 302 is converted into voltage for the system load in the voltage conversion unit 304 and is supplied to the system load 305. On the other hand, electric power from which the system load current is subtracted is charged in the electric accumulation unit 309 by the charge control unit 308. The accumulated electricity amount of the electric accumulation unit 309 is monitored by the accumulated electricity amount detection unit 310. When a predetermined value is charged, charging in the electric accumulation unit 309 is stopped by the charge control unit 308. Electric power charged in the electric accumulation unit 309 is supplied via the voltage conversion unit 311 to the drive load 312. In a case in which the accumulated electricity amount of the electric accumulation unit 309 falls below the predetermined value due to operation of the drive load 312, charging is conducted by the charge control unit 308.

<Entire Control Configuration>

FIG. 4 is a block diagram illustrating an entire control configuration of the recording apparatus according to the present embodiment. Components in the control configuration can broadly be classified into software control units and hardware processing units. The software control units correspond to the system load 305 in FIG. 3 and include processing units respectively accessing a main bus line 405 in FIG. 4 such as an image input unit 403, an image signal processing unit 404 corresponding to the image input unit 403, and a central control unit (CPU) 400. Also, the hardware processing units correspond to the drive load 312 in FIG. 3. The drive load 312 includes processing units such as an operation unit 408, a recovery operation control circuit 409, a head temperature control circuit 414, a head drive control circuit 416, a carriage drive control circuit 406, and a conveyance control circuit 407 in FIG. 4. The CPU 400 normally includes a ROM 401 and a RAM 402, gives appropriate recording conditions to input information, drives the ink ejecting heaters 210 and 212 in the recording heads 107 and 108, and conducts recording. The CPU 400 also controls the charge control unit 308 based on information about the accumulated electricity amount of the electric accumulation unit 309 that the accumulated electricity amount detection unit 310 has detected. The CPU 400 further controls the head temperature control circuit 414 based on information about the accumulated electricity amount of the electric accumulation unit 309 that the accumulated electricity amount detection unit 310 has detected.

Also, the ROM 401 has prestored therein a program executing recovery operation of the recording heads and gives recovery conditions such as preliminary ejecting conditions to the recovery operation control circuit 409 and the recording heads 107 and 108. A recovery motor 410 drives the recording heads 107 and 108, and a wiping blade 411, a cap 412, and a suction pump 413 conducting recovery operation for the recording heads 107 and 108. The head temperature control circuit 414 determines driving conditions for the sub-heater 207 on each of the recording heads 107 and 108 based on a detection result of the diode sensor 203 detecting a head temperature. The head drive control circuit 416 drives the sub-heater 207 based on the determined driving conditions.

The head drive control circuit 416 also drives the ejecting heaters 210 and 212 on each of the recording heads 107 and 108. Driving the heaters 210 and 212 causes the recording heads 107 and 108 to perform ink temperature control for ink ejection, preliminary ejection, and temperature control. A program for executing the temperature control is stored in the ROM 401, for example, and causes detection of a head temperature, driving of the sub-heater 207, and the like to be executed via the head temperature control circuit 414, the head drive control circuit 416, and the like. Meanwhile, the head drive control circuit 416 drives the ink ejecting heaters 210 and 212 by driving signals including pre-pulses and main pulses to cause ink to be ejected.

<Head Temperature Acquisition Control>

Next, head temperature acquisition control according to the present embodiment will be described.

FIG. 5 is a block diagram illustrating a flow of processing in the head temperature control circuit 414 and processing performed on software via the ROM 401 and the RAM 402. When voltage based on a head temperature is input from the diode sensor 203 provided in each of the recording heads 107 and 108 into the head temperature control circuit 414, an amplifier 501 amplifies a voltage value. The amplified voltage value is then digitalized in an AD converter 502. The digitalized diode sensor voltage value ADdi is converted into a diode temperature Th with use of an ADdi-temperature conversion equation 503 stored in the ROM 401. The diode temperature Th acquired as above is input into a head temperature detection unit 504 and is used for control according to the present embodiment described below.

<Heating Recovery Control>

In the present embodiment, out of heating control operations, heating recovery control, in which bubbles stalled around the ejection ports are eliminated (or at least minimized) from the places around the ejection ports, will be described. In the heating recovery control, the head temperature is first increased (90° C.), and bubbles in the ink are expanded, to move the bubbles from the places around the ejection ports to an ink tank side. Thereafter, the head temperature is decreased to cause the bubbles remaining around the ejection ports to be contracted. The contracted bubbles remaining around the ejection ports are ejected together with ink by preliminary ejection. In the following description, the head temperature is increased by giving as short pulses as not to cause ink to generate bubbles to the heaters provided for the respective ejection ports of each of the recording heads. Alternatively, the head temperature may be increased by heating the sub-heater or in another way.

FIG. 6 is a flowchart of entire heating recovery control. The heating recovery control is processing performed by operating the recovery operation control circuit 409 and the recording heads 107 and 108 by the program stored in the ROM 401.

In a heating sequence in S101, the head is heated to reach a target temperature T2 (90° C. in this case). The temperature is a temperature detected in the temperature detection unit 504. When the temperature of the head reaches the target temperature T2, heating is stopped in S102. Subsequently, in S103, the head stands by until the temperature is decreased to a target temperature T3 (operation start target temperature) at which a subsequent operation is to be started. Since heat dissipation from the head is generated, the head temperature naturally decreases while the head is standing by. However, a cooling device may be used. When the head temperature is decreased to T3, preliminary ejection of each of the recording heads 107 and 108 is conducted in S104.

FIG. 7 is a control flowchart of a comparative mode of the heating sequence in S101 in FIG. 6. In S201 in FIG. 7, short pulse heating is executed. Subsequently, in S202, the head temperature is detected to determine if the temperature is the target temperature T2 or higher. In a case in which the temperature is T2 or lower, the sequence returns to S201, and heating is continued. When the temperature is T2 or higher, the sequence ends.

FIG. 8 is a control flowchart of the first embodiment of the heating sequence in S101 in FIG. 6. The control according to the present embodiment is classified into before-heating control S301, first control S302 to S304, and second control S305 to S306. First, in S301, the recovery operation control circuit 409 determines whether or not the current accumulated electricity amount detected in the accumulated electricity amount detection unit 310 is a before-heating threshold value or higher. In a case in which the before-heating threshold value is set to 100% of the capacitance of the capacitor, the charging efficiency will be lowered. In consideration of this, the before-heating threshold value is set to 90% of the capacitance of the capacitor. In a case in which the accumulated electricity amount is the before-heating threshold value or higher, the sequence proceeds to S302. In a case in which the accumulated electricity amount is the before-heating threshold value or lower, the sequence returns to S301.

In S302, the recovery operation control circuit 409 determines whether or not the current accumulated electricity amount detected in the accumulated electricity amount detection unit 310 is a during-heating threshold value or higher. In the present embodiment, each of the threshold values in S301 and S302 is preferably a value which corresponds to electric power to be consumed in the second control or higher. Alternatively, each of the threshold values in S301 and S302 may be a value for an accumulated electricity amount satisfying a condition in which electric power including supply power to be supplied from the external power supply 301 during execution of the second control and the accumulated electricity amount is electric power to be consumed in the second control or higher. Also, the threshold values in S301 and S302 may differ from each other. In a case in which the before-heating threshold value in S301 is set to be higher, heating can be conducted smoothly. In this case, in S302, which is a step after it is determined in S301 that the accumulated electricity amount is the before-heating threshold value or higher, the accumulated electricity amount is the during-heating threshold value or higher. In a case in which the accumulated electricity amount is the during-heating threshold value or higher in S302, heating is conducted under first conditions in S303, and the sequence proceeds to S304. In a case in which the accumulated electricity amount is the during-heating threshold value or lower, the sequence proceeds to S304.

In a case in which the head temperature does not reach a target temperature T1 (middle target temperature) in S304, the sequence returns to S302, and processing is performed. In a case in which the head temperature reaches the target temperature T1 in S304, the sequence proceeds to the second control. Since the head is heated to 90° C. in the heating recovery processing according to the present embodiment, the target temperature T1 is set to approximately 40° C. As the condition for determination in S304, not a temperature but time of heating in the first control may be used. The temperature detection unit 504 and the system load 305 may include timers keeping time, and in a case in which the head cannot be heated until the temperature reaches the target temperature T1 even by supplying the same current due to a temporal change or the like, the sequence may proceed to the second control when a predetermined period of time has passed since heating.

Subsequently, in S305, heating is performed under second conditions under which electric power equal to or higher than electric power under the first conditions is consumed. At this time, the accumulated electricity amount accumulated in the electric accumulation unit 309 may decrease. Thereafter, in S306, the recovery operation control circuit 409 determines whether or not the head temperature reaches the target temperature T2 (reached target temperature), which is an ultimate target temperature at the time of increasing the temperature. In a case in which the temperature does not reach T2, the sequence returns to S305 to continue heating. In a case in which the temperature reaches T2, the heating sequence ends.

In the present embodiment, the target temperature T1 in the first control is set to 40° C. The head temperature reaches 40° C. in some cases depending on an image to be recorded. In a case in which S301 is not provided, the head temperature may be the middle target temperature or higher while the accumulated electricity amount is small, and the accumulated electricity amount may be insufficient although the sequence proceeds to the second control. The step S301 is provided to prevent this phenomenon from occurring. In a case in which the middle target temperature is set to a temperature that cannot be reached normally at the time of the heating sequence, S301 may not be provided.

Each of FIGS. 9 and 10 is a graph illustrating the relationship between the head temperature and the accumulated electricity amount at the time of the heating sequence. FIG. 9 is a graph obtained when the heating sequence according to the comparative mode is conducted based on the flowchart in FIG. 7. FIG. 10 is a graph obtained when the heating sequence according to the present embodiment in FIG. 8 is conducted. In each of the figures, the solid line represents the head temperature while the dashed line is the accumulated electricity amount.

In FIG. 9, the head is heated, and the temperature is increased from a normal temperature to T2 without changing the control method. In this heating method, electric power accumulated in the electric accumulation unit 309 is exhausted before the temperature reaches the target temperature T2. In this case, electric power is supplied from the external power supply 301 to the electric accumulation unit 309, the head needs to stand by until the electric accumulation unit 309 is sufficiently charged, and the temperature is decreased while the head is standing by. In a case in which the temperature is decreased to the normal temperature or so while the head is standing by, the head can be heated only to the same temperature as the previous temperature even when the head is heated again, and the temperature does not reach the target temperature T2.

Conversely, in FIG. 10, T1, which is lower than the target temperature T2, is set as the target temperature in the first control. The head temperature gradually increases as a result of heating in the first control. The accumulated electricity amount during the period is kept around a predetermined threshold value. When the head temperature reaches the target temperature T1, heating is started in the second conditions, in which heating is more intense and requires higher power consumption than in the first conditions. In the present embodiment, in the second conditions, the short pulse heating is conducted, in which the pulse width is longer than that in the first conditions. The head is heated in the second conditions to cause the head temperature to increase rapidly and is kept heated to reach the target temperature T2. As illustrated in FIG. 10, in a case in which time of heating in the second conditions is assumed to be a unit of time, the temperature increases per unit of time more significantly in heating in the second conditions than in heating in the first conditions. During heating in the second conditions, the accumulated electricity amount decreases only for a period of time for which the temperature increases from T1 to T2. Thus, the temperature can reach the target temperature T2 without exhausting the accumulated electric power until the end of the second control.

As described above, even in a case in which the accumulated electricity amount that the electric accumulation unit 309 can accumulate is an accumulated electricity amount that prevents the head temperature from reaching the target temperature T2 when the head is heated without changing the control method as in FIG. 7, step-by-step heating allows the head to be heated to a higher temperature than in the case of increasing the temperature without changing the control method.

Second Embodiment

While the first embodiment has a system configuration including the accumulated electricity amount detection unit, in the present embodiment, a mode including a supply power detection unit detecting supply power from an outside will be described. Similar parts to those in the first embodiment are omitted in the description.

FIG. 11 is a block diagram illustrating a schematic functional configuration of an image forming apparatus according to a second embodiment. It is to be noted that identical components to those illustrated in FIGS. 2A to 2C are shown with the same reference signs, and description of the duplicate components is omitted. A supply power detection unit 303 according to the present embodiment detects and measures electric power that can be supplied from the external power supply input unit 302. The detection of the electric power that can be supplied is preferably performed automatically by connection to the external power supply 301. For example, in a case in which the shape of the external power supply input unit 302 corresponds to a USB, each standard can be identified with use of a communication line of the USB. Alternatively, a dedicated connector may be used for the external power supply input unit 302, and each standard may be identified with use of communication or the like uniquely specified by the supply power detection unit 303 and the external power supply 301. With use of the aforementioned supply power detection unit 303, for each of different electric power values that can be supplied complying with a plurality of standards, electric power to be accumulated by the charge control unit 308 can be set appropriately. Also, the system control unit 306 includes a not-illustrated timer keeping time.

Also, voltage drop is generated due to resistance components in a connector, a cable, or the like connecting the external power supply 301 to the external power supply input unit 302. For this reason, it is more preferable to measure actual electric power that can be supplied than to detect logical electric power that can be supplied. The actual supply power can be measured by measuring current or voltage. Accordingly, it is possible to prevent the external power supply 301 from being stressed by causing the external power supply input unit 302 to supply higher power than the actual supply power. In a case in which the power that can be supplied is detected with use of the aforementioned communication or standard, it is preferable to set lower charge power than logical power that can be supplied. The supply power detection unit 303, as well as the accumulated electricity amount detection unit 310, is connected to the system control unit 306, and the supply power is used as information for control according to the present embodiment.

FIG. 12 is a control flowchart obtained when a heating sequence according to the second embodiment is conducted. In the present embodiment, since the accumulated electricity amount of the electric accumulation unit 309 is unknown, time since most recent use of electric power of the electric accumulation unit 309 is kept with use of a timer, and the heating sequence is started when time to reach a sufficient accumulated electricity amount has passed. In S401, the supply power detection unit 303 detects supply power. Subsequently, in S402, heating is conducted with electric power equal to or less than the supply power detected in S401. Specific ways thereof are shortening a pulse width to be applied to the ejecting heaters and the sub-heaters, lowering frequency for applying the pulses, lowering voltage to be applied to the heaters, and the like. Subsequently, in S403, in a case in which the head temperature is lower than the middle target temperature T1, the sequence returns to S401 to detect supply power, and heating is conducted again in S402. In a case in which the head temperature is higher than the middle target temperature T1, the second control is conducted in S404. Since the second control in S404 and S405 is similar to the second control in S304 and S305 in FIG. 8 in the first embodiment, description thereof is omitted.

In the above manner, in the second embodiment as well, control causing the result in FIG. 10 can be done.

Also, a mode including both the accumulated electricity amount detection unit and the supply power detection unit is available. In a case of heating in the first control, heating conditions such as a pulse width can be set so that heating may be conducted with electric power equal to or less than the supply power detected in the supply power detection unit. However, since the driving voltage and the pulse width vary in some cases, heating may not be conducted with electric power equal to or less than the supply power. In this case, in a case in which the accumulated electricity amount detection unit detects the accumulated electricity amount, a set accumulated electricity amount can be maintained. In this manner, including both the accumulated electricity amount detection unit and the supply power detection unit allows more accurate heating to be conducted.

Although the heating recovery control has been described above, this can be applied to other heating control. In a case in which the head temperature is low at the time of preliminary ejection or ejection for recording, ejection of as much ink as a desired amount or ejection cannot be conducted in some cases. In this case, the head temperature is increased to a predetermined temperature such as approximately 50° C. before ejection to bring about a state in which preparation for ejection is completed. In a case in which the head temperature is below 50° C. before starting recording or before starting subsequent scanning after completion of present scanning, the short pulse heating is conducted. At the time of recording, the ejecting heaters are driven depending on the image, and not all the ejecting heaters are thus driven at the same time. However, in the heating control, since all the ejecting heaters are driven at a time, higher electric power is consumed than at the time of recording. In a case in which the head temperature is below 50° C., the ejecting heaters are driven at a time by the short pulse heating to increase the head temperature. At this time, the step-by-step heating allows the temperature to be increased to 50° C., which is the target temperature. However, in a case in which the electric accumulation unit 309 has ability to accumulate as large an accumulated electricity amount as to heat the head to 50° C., heating may be conducted in the second control in FIG. 8 in the first step. Alternatively, the head temperature may be increased by the sub-heater during scanning for recording.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, in a case in which the capacity of an electric accumulation element has limitation, step-by-step heating allows a temperature to be increased to a high temperature.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-142385, filed Jul. 30, 2018, which is hereby incorporated by reference herein in its entirety.

What is claimed is:

1. A recording apparatus comprising:

a recording head including an ejection port for ejecting ink and a heating element for heating the recording head to heat ink in the recording head;

a detection unit configured to detect a temperature of the recording head;

an electric accumulation unit configured to accumulate electric power supplied from an external power supply;

an acquisition unit configured to acquire information about an accumulated electricity amount accumulated in the electric accumulation unit; and a heating control unit configured to drive the heating element to heat the recording head such that the recording head temperature reaches a reached target temperature with use of the electric power accumulated in the electric accumulation unit based on a detection result of the recording head temperature by the detection unit and the acquired information, wherein, in a state in which the electric power is being supplied from the external power supply to the electric accumulation unit, the heating control unit conducts first heating control of heating the recording head to a middle target temperature and then heats the recording head in second heating control of consuming higher electric power than that in the first heating control to increase the recording head temperature to a reached target temperature, which is higher than the middle target temperature, and the heating control unit conducts the first heating control such that the accumulated electricity amount of the electric accumulation unit does not fall below an accumulated electricity amount required for the second heating control at a stage of moving from the first heating control to the second heating control.

2. The recording apparatus according to claim 1, wherein the heating control unit acquires the detection result of the recording head temperature during the first heating control and, in a case in which the temperature shown by the detection result is higher than a threshold value, the heating control unit moves heating control for the recording head from the first heating control to the second heating control.

3. The recording apparatus according to claim 2, wherein, in a case in which the reached target temperature is a first temperature, the threshold value is set to a first value and, in a case in which the reached target temperature is a second temperature, which is higher than the first temperature, the threshold value is set to a second value, which is higher than the first value.

4. The recording apparatus according to claim 2, further comprising a detection unit configured to detect supply power to be supplied from the external power supply to the electric accumulation unit, wherein, based on the supply power detected, at time of conducting the first heating control, the heating control unit conducts heating with electric power equal to or less than the supply power and, in a case in which the supply power is first power, the threshold value is set to a third value and, in a case in which the supply power is second power, which is higher than the first power, the threshold value is set to a fourth value, which is higher than the third value.

5. The recording apparatus according to claim 1, further comprising a time-keeping unit configured to keep time, wherein, in accordance with time kept by the time-keeping unit, the heating control unit ends the first heating control when a predetermined amount of time has passed since start of the first heating control and starts the second heating control.

6. The recording apparatus according to claim 1, wherein, in a case in which the accumulated electricity amount shown by the acquired information is larger than a predetermined accumulated electricity amount, the heating control unit starts the first heating control.

7. The recording apparatus according to claim 6, wherein the predetermined accumulated electricity amount is an electric power amount to be consumed in the second heating control.

8. The recording apparatus according to claim 1, further comprising a power detection unit configured to detect supply power to be supplied from the external power supply to the electric accumulation unit, wherein, based on the supply power detected, at time of conducting the first heating control, the heating control unit heats the recording head with electric power equal to or less than the supply power.

9. The recording apparatus according to claim 1, wherein, in a case in which the recording head is heated to the reached target temperature in the second heating control without conducting the first heating control, an accumulated electricity amount that can be accumulated in the electric accumulation unit is smaller than an electric power amount to be consumed.

10. The recording apparatus according to claim 1, wherein the heating control unit conducts the first heating control and the second heating control before starting ejecting ink as preparation for ink ejection of the recording head.

11. The recording apparatus according to claim 1, wherein, when the recording head temperature decreases to a third target temperature, which is lower than the reached target temperature, after the heating control unit ends the second heating control, ink is ejected from the ejection port to cause preliminary ejection not contributing to image recording to be conducted.

12. A recording apparatus comprising:

a recording head including an ejection port for ejecting ink and a heating element for heating the recording head to heat ink in the recording head;

a first detection unit configured to detect a temperature of the recording head;

an electric accumulation unit configured to accumulate electric power supplied from an external power supply;

a second detection unit configured to detect supply power to be supplied from the external power supply to the electric accumulation unit; and a heating control unit configured to drive the heating element such that the recording head temperature reaches a target temperature based on a detection result of the recording head temperature by the first detection unit and the supply power detected by the second detection unit, wherein, in a state in which the electric power is being supplied from the external power supply to the electric accumulation unit, the heating control unit conducts first heating control of heating the recording head to a middle target temperature and then heats the recording head in second heating control of consuming higher electric power than that in the first heating control to increase the recording head temperature to an ultimate target temperature, which is higher than the middle target temperature and, in the first heating control, the heating control unit heats the recording head with electric power equal to or less than the supply power detected.

13. The recording apparatus according to claim 12, wherein the heating control unit acquires the detection result of the recording head temperature during the first heating control and, in a case in which the temperature shown by the detection result is higher than a threshold value, the heating control unit moves heating control for the recording head from the first heating control to the second heating control.

14. The recording apparatus according to claim 12, further comprising a time-keeping unit configured to keep time, wherein, in accordance with time kept by the time-keeping unit, the heating control unit ends the first heating control when a predetermined amount of time has passed since start of the first heating control and starts the second heating control.

15. The recording apparatus according to claim 12, wherein the heating control unit conducts the first heating control and the second heating control before starting ejecting ink as preparation for ink ejection of the recording head.

16. The recording apparatus according to claim 12, wherein, when the temperature decreases to an operation start target temperature, which is lower than the ultimate target temperature, after the heating control unit ends the second heating control, ink is ejected from the ejection port to cause preliminary ejection not contributing to image recording to be conducted.

17. A method for controlling a recording apparatus, wherein the recording apparatus includes a recording head including an ejection port for ejecting ink and a heating element for heating the recording head to heat ink in the recording head, a detection unit configured to detect a temperature of the recording head, an electric accumulation unit configured to accumulate electric power supplied from an external power supply, and an acquisition unit configured to acquire information about an accumulated electricity amount accumulated in the electric accumulation unit, the method comprising:

conducting heating control, wherein, in a state in which the electric power is being supplied from the external power supply to the electric accumulation unit, conducting includes using the heating element to conduct first heating control of heating the recording head to a middle target temperature and then heating the recording head in second heating control of consuming higher electric power than that in the first heating control to increase the recording head temperature to an ultimate target temperature, which is higher than the middle target temperature, and conducting the first heating control such that the accumulated electricity amount of the electric accumulation unit does not fall below an accumulated electricity amount required for the second heating control at a stage of moving from the first heating control to the second heating control.

18. The method for controlling a recording apparatus according to claim 17, wherein acquiring includes acquiring the detection result of the recording head temperature during the first heating control and, in a case in which the temperature shown by the detection result is higher than a threshold value, heating control for the recording head is moved from the first heating control to the second heating control.

19. The recording apparatus according to claim 17, wherein, in a case in which the accumulated electricity amount shown by the acquired information is larger than a predetermined accumulated electricity amount, the first heating control is started.

* * * * *